US005933878A

United States Patent [19]

Suehiro et al.

[11] Patent Number: 5,933,878

[45] Date of Patent: Aug. 10, 1999

[54] TANK DEVICE FOR FLUSHING TOILET BOWL

[75] Inventors: Katsuyuki Suehiro; Shinji Shibata; Toshiaki Kayahara, all of Kitakyushu, Japan

[73] Assignee: Toto, Ltd., Fukuoka-ken, Japan

[21] Appl. No.: 08/945,223

[22] PCT Filed: Apr. 9, 1997

[86] PCT No.: PCT/JP97/01207

§ 371 Date: Oct. 17, 1997

§ 102(e) Date: Oct. 17, 1997

[87] PCT Pub. No.: WO97/41314

PCT Pub. Date: Nov. 6, 1997

[30] Foreign Application Priority Data

Apr. 26, 1996 [JP] Japan ..... 8-108039

[51] Int. Cl.[6] ..... E03D 5/00

[52] U.S. Cl. ..... 4/405; 4/410; 4/378

[58] Field of Search ..... 4/410, 378, 392, 4/393, 413, 414, 386, 387, 388, 389, 390, 379, 391, 394, 395, 396, 380, 381, 382, 383, 384, 385, 397, 398, 399, 400, 401, 402, 403, 404

[56] References Cited

U.S. PATENT DOCUMENTS

| | | | |
|---|---|---|---|
| 2,904,795 | 9/1959 | Wagner | 4/397 |
| 4,811,432 | 3/1989 | Harris | 4/393 |
| 5,205,000 | 4/1993 | Xia et al. | 4/324 |

FOREIGN PATENT DOCUMENTS

| | | | |
|---|---|---|---|
| 2612535 | 3/1987 | France | 4/405 |
| 2707316 | 7/1993 | France | 4/405 |
| 4-7120 | 6/1929 | Japan . | |
| 46-63928 | 7/1971 | Japan . | |
| 52-69841 | 5/1977 | Japan . | |
| 6-67570 | 9/1994 | Japan . | |

*Primary Examiner*—David J. Walczak
*Attorney, Agent, or Firm*—Birch, Stewart, Kolasch & Birch, LLP

[57] ABSTRACT

A tank device for flushing a toilet bowl includes a tank body in which flushing water is stored and in which a discharge opening is provided at the bottom. A discharge valve body is linked to the discharge opening at the bottom of the tank body. The discharge opening is formed with a valve seat on the upper end and communicates with an overflow pipe at the downstream side of the valve seat. Driving members are provided which separate a valve body from the valve seat. A support member is provided for supporting the driving members, which is fitted onto the overflow pipe and which is seated at the lower end on the bottom of the tank body. A force is applied to an actuator from outside of the tank body to separate the valve body from the valve seat.

9 Claims, 6 Drawing Sheets

TANK DEVICE FOR FLUSHING TOILET BOWL

TECHNICAL FIELD

This invention relates to a tank device for flushing a toilet bowl which is provided for a flush toilet bowl and which is adapted to be operated by means of a push-button provided on a tank lid.

BACKGROUND ART

In regard to flushing water tanks for flushing toilet bowls, two types which are provided in a seat type of flush toilet bowl are widely known, i.e., one type where the flushing water tank body is separate from, but secured to, the toilet bowl, and the other being a one piece type where the flushing water tank is integrally formed with the toilet bowl. In these flushing water tanks, the one piece type tank is said to be preferable in terms of the design of the whole toilet bowl, because it can be made lower in height.

In such a flushing water tank, the operation of opening a discharge valve provided to supply flushing water into the bowl of the toilet bowl body is generally carried out by means of a lever provided on the peripheral wall of the tank or a push-button provided on the lid. FIG. 7 shows an example of the construction of operating a discharge valve using a conventional push-button.

This flushing water tank comprises a push-button 53 for operation provided in the middle of the width from side to side of a lid 52 of a tank body 51, and a discharge valve body 54 fitted at the bottom of the tank body 51. The discharge valve body 54 can be brought into and out of a seating engagement with a discharge valve seat 55*a* which is formed at the lower end of an overflow pipe 55 rising from a discharge opening 51*a* of the tank body 51, and it is linked to the overflow pipe 55 for up and down swing motion. To the upper end of the overflow pipe 55 is attached an arm 56 by means of a pin 55*b*, and the arm 56 is linked at one end thereof to the push button 53 and is connected to at the other end to a ball chain 57 connected the discharge valve body 54.

With such a construction, when the push-button 53 is pressed downward, the arm 56 is pivotally moved about the pin 55*b* clockwise to pull the ball chain 57 upward, thereby allowing the discharge valve body 54 to be opened.

However, in order to pull the discharge valve body 54 upward to a sufficiently high level when the push button 53 is pressed to pivotally move the arm 56, it is necessary to make the length of the arm 56 from the connecting point of the pin 55*b* to that of the ball chain 57 longer and, accordingly, the length of the arm from the connecting point of the pin 55*b* to that of the push button 53 becomes shorter. This causes the load which is applied when the push-button 53 is pressed to be concentrated to the upper end of the overflow pipe 55 by way of the pin 55*b*.

When such a load concentration to the upper end of the overflow pipe 55 occurs, a deflection of the overflow pipe 55 is brought about and the deterioration of the strength thereof is caused by a fatigue due to the repeated load. Such a tendency of the deflection and the deterioration of the strength cannot be ignored since synthetic resin pipes are used for almost all overflow pipes 55.

Also, the lower end portion of the overflow pipe 55 is inserted into the discharge opening 51*a* of the tank body 51 and is connected to the water supply line of the toilet bowl body being sealed by a sealing means such as a packing or the like. However, if the above-described deflection and the deterioration of the strength occur, the sealed portion is also affected, thus causing the danger of water leakage.

Thus, in the system of operating the discharge valve using the push button, there is a problem of a poor water-sealing property in the discharge valve portion because the push button continues to be pressed longer than the time necessary, thereby causing the concentration of a load applied to the overflow pipe when the operation is carried out.

SUMMARY OF THE INVENTION

The present invention has been made taking the above-described problems into consideration, and aims at providing a flushing water tank device which enables the sealing property in the portion of the discharge valve to be better maintained, even when a load is applied by the operation of the push-button.

A tank device for flushing a toilet bowl according to the present invention comprises a tank body in which flushing water is stored and in which is provided at the bottom with an opening for discharge, a discharge valve provided linked to the bottom opening of said tank body, a valve body which is adapted to be brought into a seating engagement with a valve seat formed on the upper end of said discharge valve, and an operating part for separating said valve body from said valve seat, said operating part comprises a driving member which brings about the separating motion of said valve body by an operation of pressure from the outside of the tank body, and a support member for supporting said driving member, said support member being supported by said tank body.

Further, a tank device for flushing toilet bowl according to the present invention is characterized in that an overflow pipe disposed with a vertical rise within the tank body communicates with the downstream side of said valve seat of the discharge valve, and said support member is fitted onto said overflow pipe and the lower end of said support member is seated on the bottom surface of the tank body.

Moreover, a tank device for flushing a toilet bowl according to the present invention comprises a tank body in which flushing water is stored and in which is provided at the bottom with an opening for discharge, a discharge valve provided linked to the bottom opening of said tank body, a valve body which is adapted to be brought into a seating engagement with a valve seat formed on the upper end of said discharge valve, and an operating part for separating said valve body from said valve seat, said operating part comprises a driving member which brings about the separating motion of said valve body by an operation of pressure from the outside of the tank body, and a support member for supporting said driving member, said support member being supported by the lower portion of said discharge valve.

Further, a tank device for flushing a toilet bowl is characterized in that an overflow pipe disposed with a vertical rise within the tank body communicates with the downstream side of said valve seat of the discharge valve, and said support member is fitted onto said overflow pipe and the lower portion of said support member engages hooks provided so as to protrude from the lower portion of said overflow pipe.

According to the present invention, when an operation for discharging the flushing water within the flush tank is performed, a force of pressure which acts on the support member from the operating part by way of the driving member is transmitted directly to the tank body without acting on the discharge valve and is supported by the tank body, so that the deflection and deformation of the discharge valve can be prevented while better maintaining the sealing property of the discharge valve part.

Further, also in the case where the discharge valve is provided with the overflow pipe, onto which the support member is fitted, a force of pressure, transmitted to the support member when the operation is made, is transmitted to the bottom of the tank body, on which the support member is seated, thereby preventing the deflection and deformation of the overflow pipe.

Moreover, in the case where the support member is supported by the hooks protruding from the lower portion of the discharge valve or the lower portion of the overflow pipe, the moment of a force which acts on the discharge valve due to the load becomes small compared with the conventional case where the support member is supported by the upper end portion of the overflow pipe, so that the deformation and deflection of the discharge valve is prevented, thereby allowing a sealing property of the discharge valve part to be better maintained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF EXPLANATION OF DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
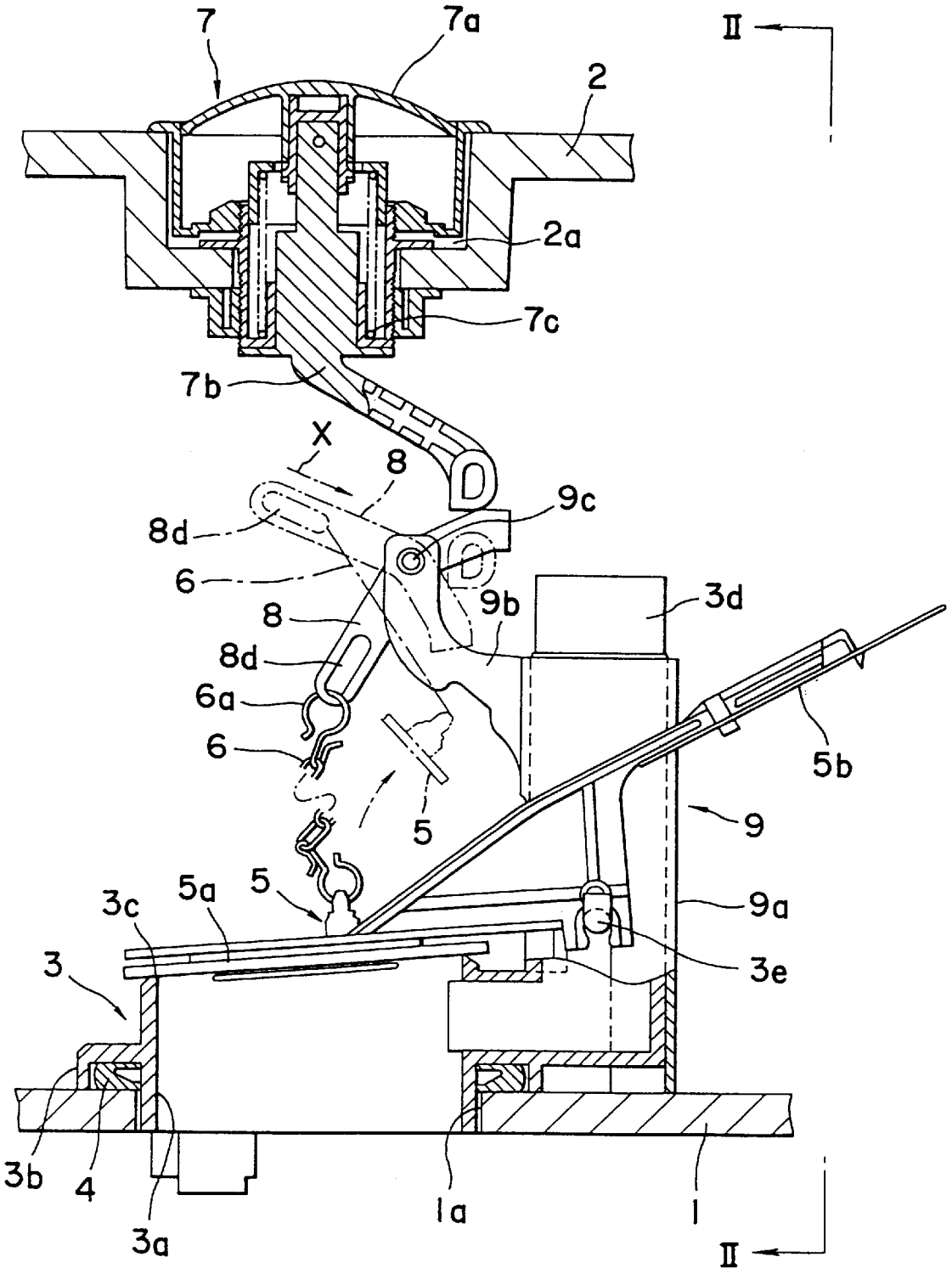
FIG. 1 is a side view of an essential portion of a toilet bowl flushing water tank according to the invention, with parts partially broken away.
Figure 2:
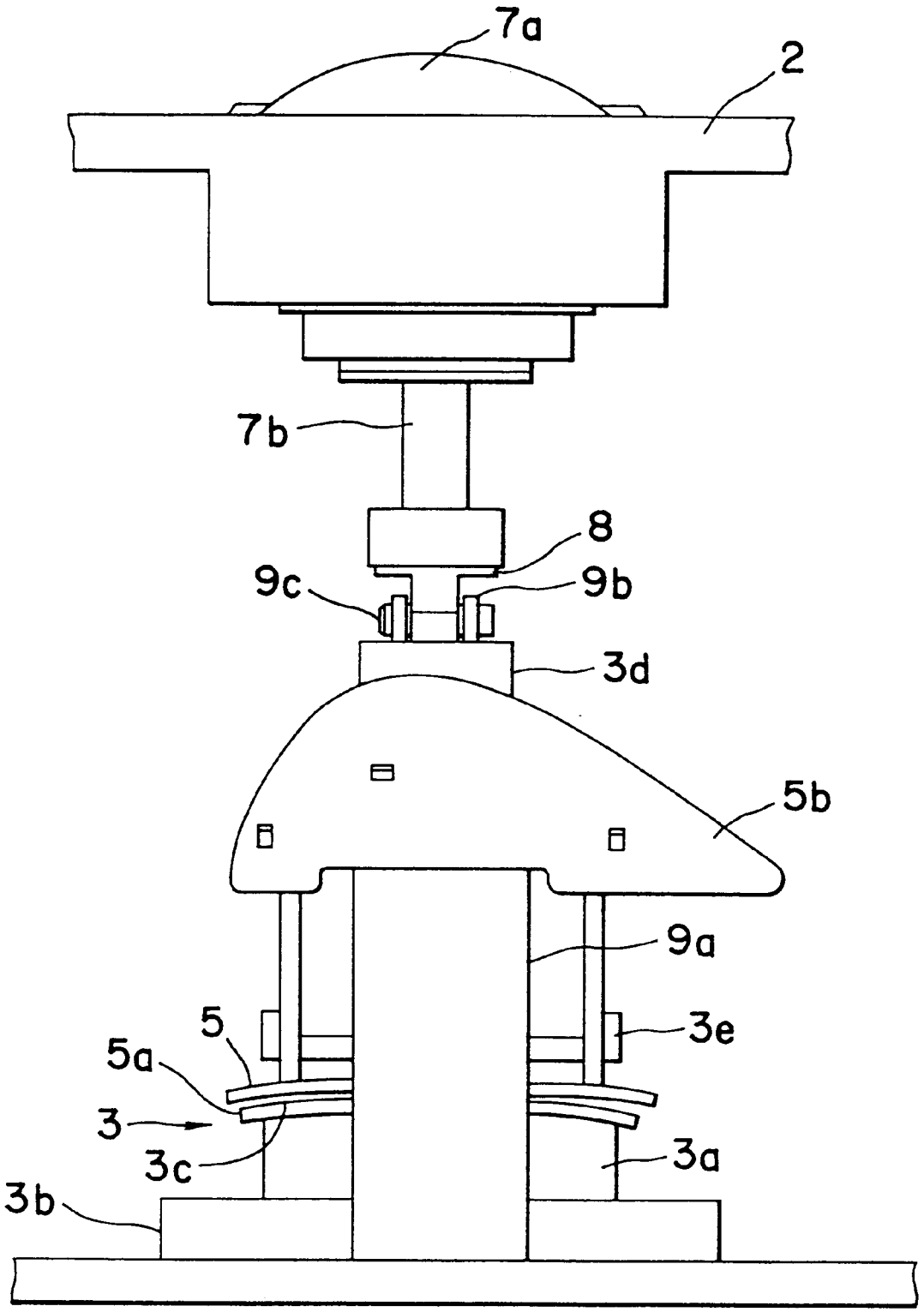
FIG. 2 is a view as viewed in the direction of line II—II of FIG. 1.

FIG. 1 is a cut-away view showing an essential portion of a flushing water tank device according to the present invention, and FIG. 2 is a side view as viewed in the direction of line II—II of FIG. 1.

Referring to the drawings, similar to the construction shown in the prior art example, a lid 2 is detachably mounted on the upper end of a tank body 1, and the tank body 1 and the lid 2 each are formed in the middle of the width from side to side as viewed from the front, with an opening 1*a* facing the flushing water line towards the toilet bowl area and a recess 2*a* into which an operating part is incorporated.

In this connection, the tank body 1 is of a one piece type, in which it is integrally formed with a toilet bowl body, and the bottom of the tank body 1 is formed as a portion of the toilet bowl body.

The lower end of a discharge valve body 3 is inserted into and fixed to the opening 1*a* of the tank body 1. The discharge valve body 3 is tightly fixed to the opening 1*a* in such a way that a flange 3*b* is formed around a discharge pipe 3*a,* which is passed through the opening 1*a,* and a packing 4 is incorporated into the portion enclosed by the peripheral surface of the discharge pipe 3*a* and the lower surface of the flange 3*b,* said discharge pipe 3*a* being formed on the upper end surface with a valve seat 3*c* having a gentle slope falling toward the left side as shown in the drawing.

Further, the discharge pipe 3*a* is integrally formed with an overflow pipe 3*d* which rises vertically protruding outwardly from the peripheral wall at the right side as viewed in the drawing. When a quantity of flushing water supplied from the outside to the tank body 1 becomes too much and the water level has risen higher than the upper end of the overflow pipe 3*d,* the overflow pipe 3*d* makes the flushing water overflow from the top end thereof, thereby preventing an overflow from the tank body 1 to the outside, similar to the overflow pipe in the conventional flushing water tank. The construction of the overflow pipe 3*d* being integrally formed with the discharge pipe 3*a* can be replaced by the construction of the separate overflow and discharge pipes being connected to each other.

The overflow pipe 3*d* is formed in contour so that it tapers a little upwardly from the lower end, except at the upper end portion, and, as shown in FIG. 2, a pair of hooks 3*e* protrude from the lower portion of the overflow pipe 3*d* at the right and left side. These hooks 3*e* are utilized to bring a valve body 5 into and out of a seating engagement with a valve seat 3*c*.

The valve body 5 is formed at one end thereof with a valve plate 5*a* in the form of a flat plate and at the other end thereof with a braking plate 5*b* which is held on the water surface in close contact therewith by the surface tension of the water surface and which keeps the valve plate 5*a* in an opened condition from the valve seat 3*c* even when the water level gradually drops. Moreover, a connecting chain member 6 is connected to the upper surface of the valve plate 5*a* in the middle thereof.

Also, in a recess 2*a* formed in the lid 2 is provided an operating part 7 for opening the valve body 5. This operating part 7 comprises a spindle 7*b* integrally connected to a push button 7*a* and extending downwardly, and a spring 7*c* which is held on the lid 2 and which energizes the push-button 7*a* and the spindle 7*b* upward. The push button 7*a* and the spindle 7*b* are normally maintained in a condition shown in FIG. 1 by means of the spring 7*c*, and pressing the push button 7*a* allows the spindle 7*b* to drop, and releasing the pressure against the push-button 7*a* allows it to be restored to the position shown in the drawing.

To link the valve opening operation of the valve body 5 to the drop motion of the push-button 7*a,* is provided a driving arm 8 connected at one end thereof to the connecting chain member 6 and having at the other end a contour which makes contact with the lower end of the spindle 7*b*. A support member 9, to hold the driving arm 8 in a certain position, is fitted onto and fixed to the overflow pipe 3*d*. Namely, in the present embodiment, the driving member comprises a spindle 7*b* connected to the side of the operating part 7 and a driving arm 8 linked to the side of the support member 9.

The support member 9 is provided with a sleeve 9*a* having an inner tapered peripheral surface which fits onto the outer tapered peripheral surface of the overflow pipe 3*d*, and the sleeve 9*a* can be fitted onto the overflow pipe 3*d* to the position where the lower end of the sleeve 9*a* strikes the bottom surface of the tank body 1, as shown in FIG. 1. From the outer periphery at the upper end of the sleeve 9*a* protrudes a bracket 9*b* upwardly, to the upper end of which the driving arm 8 is connected in the middle portion thereof for pivotable motion about a pin 9*c*.

In the construction as described above, when the push button 7*a* is pressed down, the spindle 7*b* is lowered and the lower end thereof presses down on the right end side of the driving arm 8. The driving arm 8 is rotated clockwise about the pin 9*c* until it comes to the position shown by the broken line in the drawing. This causes the connecting chain member 6 to be pulled upward and the valve body 5 to be rotated clockwise about the hook 3*e,* whereby the valve plate 5*a* is moved away from the valve seat 3*c* to open the discharge valve, thereby allowing the flushing water to be supplied from the discharge pipe 3*a* to the toilet bowl part of the toilet bowl body.

After the valve is opened, the operation of pressing the push button 7*a* is released, and the push-button 7*a* rises together with the spindle 7*b* by the force of the spring 7*c* and is moved away from the upper end of the driving arm 8; however, the braking plate 5*b* is immersed within the flushing water to prevent a sudden rise thereof and, simultaneously, is maintained in the condition of the braking plate being energized downward by a flow of the flushing water in the downward direction due to the discharge of the flushing water from the discharge pipe 3*a*, thereby allowing the pivotable motion of the valve plate 5*a* in the valve closing direction to be slowed. Further, when the water level of the flushing water gradually drops and the braking plate 5*b* comes to coincide with the water surface, the braking plate 5*b* gets into a state of being adsorbed onto the water surface due to the surface tension. This also slows the pivotable motion of the valve plate 5*b* in the valve closing direction. Therefore, even in the case where the operation of pressing the push-button 7*a* is discontinued after a valve opening operation of the valve body 5 is made by means of the push-button 7*a,* if the angle of opening the valve body 5 is made sufficient, an immediate closing operation of the valve body 5 does not occur, and a large quantity of flushing water can be supplied to the toilet bowl side. Finally, from the time when the braking plate 5*b* is moved away from the water surface, the valve body 5 is pivotably moved in the valve closing direction and restores to the valve closing position shown in FIG. 1.

Hereupon, when the push button 7*a* is pressed, the spindle 7*b* which drops integrally therewith presses the upper end side of the driving arm 8 downward, and the load applied due to such downward pressure is further applied to a bracket 9*b* of the support member 9 by way of the pin 9*c*. However, the support member 9 is provided so that the lower end of the sleeve 9*a* fitted onto the overflow pipe 3*d* is seated on the bottom of the tank body 1 and, therefore, the load due to the downward pressure is received by the tank body 1 by way of the support member 9. Accordingly, if the rigidity of the support member 9 is made to appropriate, the upper end side of the sleeve 9*a* and overflow pipe 3*d* is prevented from bending to the left side as viewed in FIG. 1, even when the bracket 9*b* is pressed downward so that a moment of rotation acts on the upper end portion of the support member 9.

Also, the discharge valve body 3 is not restrained by the direction of the downward pressure received by the support member 9 and has no relations therewith, and an occurrence of the deflection of the sleeve 9*a* is suppressed; therefore, the load of an external force applied to the discharge valve body 3 can be suppressed to such a degree as to be insignificant. Accordingly, since the deflection and deformation of the whole discharge valve body 3 are prevented, the sealing property by the packing 4 can be better maintained and, in addition, since the valve plate 5*a* and the valve seat 3*c* surely cut off the flushing water, there is no leakage of water from the tank body 1 to the toilet bowl side.

In this embodiment, the support member 9 is designed so that it is seated on the bottom of the tank body to transmit the load applied when an operation is carried out, to the tank body 1; however, another construction can be alternatively adopted in which, for example, one end of the support member 9 is seated on and fixed to the inner peripheral wall of the tank body 1 without being fitted onto the overflow pipe 3*d*. In short, a design of the construction is preferable in which the load transmitted from the driving arm 8 to the support member 9 escapes not to the discharge valve body 3 but to the tank body 1.

Hereupon, since in the case where the tank body 1 and the lid 2 are made of ceramics, an upper limit exists in terms of the precision of dimension, there are some cases in which a delicate change occurs in the distance between the operating part 7 and the discharge valve body 3. For this reason, in the case where, when the spindle 7*b* and the driving arm 8 make contact with each other, as shown in FIG. 1, the valve body 1 is set to be in the valve closing position, if the distance between the operating part 7 and the discharge valve body 3 becomes small, the driving arm 8 is pressed downward so that a change in the position of the valve body 5 to the direction of opening the valve body 5 is caused. Therefore, there is a possibility of the leakage of flushing water being caused due to a lack in the sealing pressure of the valve body 5 against the valve seat 3*c*.

On the contrary, in the case where the connecting chain member 6 is made to properly sag when the valve is closed, as shown in FIG. 1, even when the device is assembled with the driving arm 8 being pressed down a little, the occurrence of deflection of the connecting chain member 6 allows this connecting chain member to be maintained in a situation without tension, thereby preventing the valve body 5 from floating up from the valve seat 3*c*. Therefore, even in the case of a large dimensional tolerance of the tank body 1 and lid 2 being adopted, this can be absorbed by the deflection of the connecting chain member 6.

Further, the connecting chain member 6 is linked to the driving arm 8 in such a way that the connector 6*a,* in the form of a ring, hangs from a slot 8*d* provided at the forward end of the driving arm 8, thereby allowing the connector 6*a* to move along the slot 8*d* freely. For this reason, when the valve body 5 is gradually opened and changes into the position drawn by the one dot-chain line in FIG. 1, the slot part 8*d* of the driving arm 8 is, on one hand, pivotably moved drawing a locus clockwise and, on the other hand, the connector 6*a* is moved in the direction of the arrow marked X shown with the one dot-chain line in the drawing as the driving arm 8 is gradually tilted when the driving arm is pivotally moved to a situation of the valve being opened.

Therefore, for example, in the case of the construction in which the connector 6*a* is firmly secured to the forward end of the driving arm 8, the distance between the valve body 5 and the connector 6*a* remains equal to the length of the tensed connecting chain member 6 when the valve is closed, the angle through which the valve body 5 can be pivotally moved is restricted to a small degree, while since, in the present embodiment, the connector 6*a* is moved along the slot 8*d* to the side of the valve body 5, the angle through which the driving arm 8 can be pivotally moved can be set to a large degree. This allows the valve body 5 to be opened to a sufficient degree of opening with respect to the valve seat 3*c*, whereby the flushing water from the tank body 1 can be discharged with a force of water necessary to flush the toilet bowl.

Further, in FIG. 1, when the valve body 5 is opened to the maximum degree of opening, the driving arm 8 is designed so that it is pivotally moved only to the position shown with the broken line in the drawing where the base end side of the driving arm 8 engages the bracket 9*b*.

Figure 3:
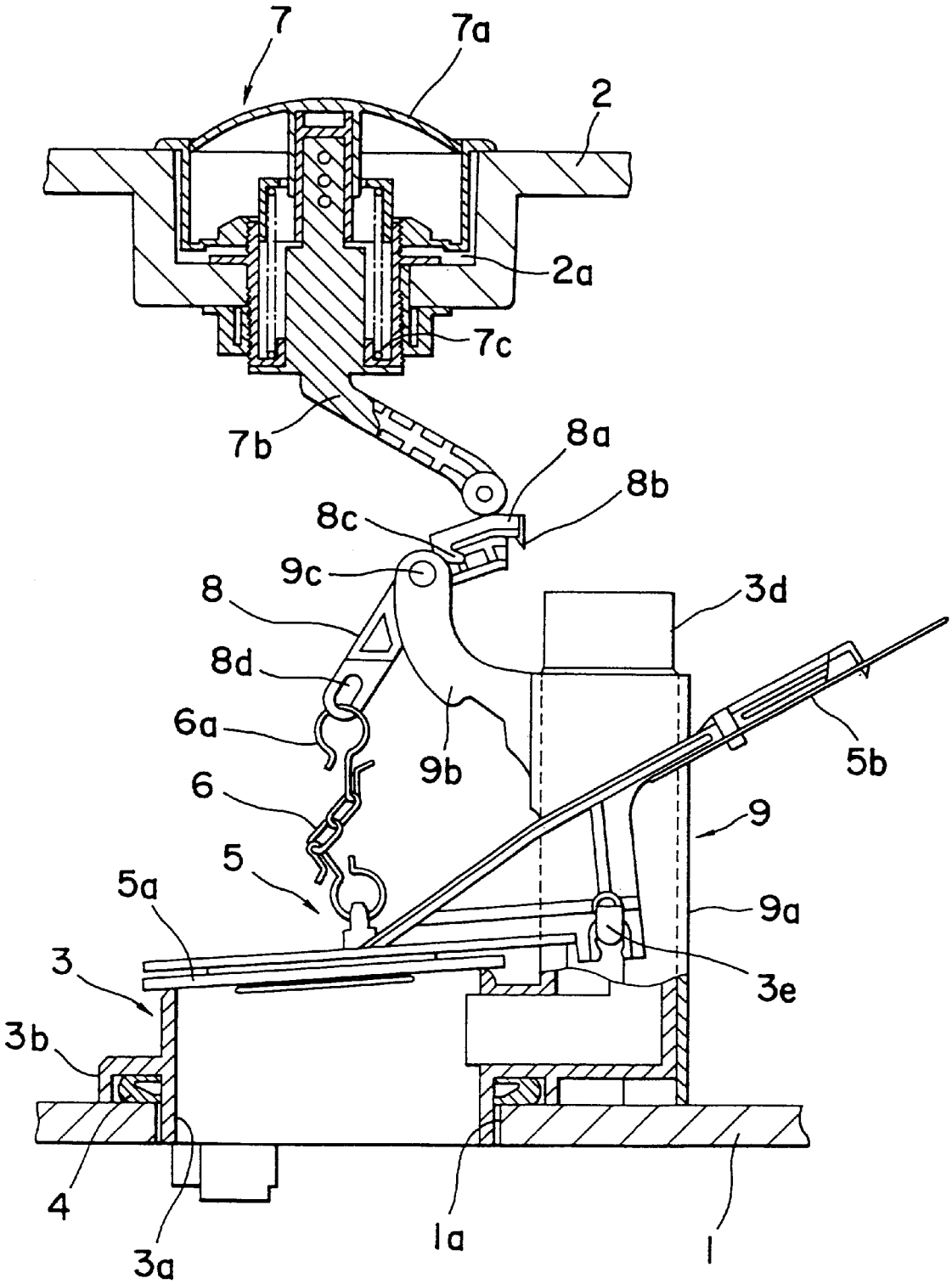
FIG. 3 is a view corresponding to FIG. 1 showing another embodiment of the invention.

FIG. 3 is a side view of another embodiment of the invention with parts partially broken away.

In this embodiment, a spacer 8*a* is removably attached to the upper end of the driving arm 8 in a position where it faces the lower end surface of the spindle 7*b*. The spacer 8*a* is made of synthetic resin and fixed to the driving arm 8 in such a way that engaging claws 8*b* and 8*c* provided on the lower surface of the spacer 8*a* at either end thereof engage the forward end of the driving arm 8.

The provision of such spacer 8*a* makes it possible to assemble the tank body 1 and the lid 2 in such a way as to absorb the molding errors, thereby allowing the tank body 1 to be held in a shape which is small in height.

Namely, the tank body 1 is produced using molds as a portion of the toilet bowl body, however, even when the tank bodies are produced by means of the same mold, if they are different in terms of the raw material of porcelain clay and the kiln which is used, the errors of approximately 5% arising from the production are found here and there in the flush toilet bowls of the one piece type flushing water tank having a general size. For example, in the case where the distance between the lower surface of the lid 2 and the bottom surface of the tank body 1 is made longer than that in the case shown in FIG. 1, it is also necessary to make the position of the discharge valve body 3 also higher to maintain a linked relation between the spindle 7*b* and the driving arm 8. However, making the position of the discharge valve body 3 higher causes the position of the overflow pipe 3*d* to rise; for example, in a specification of a ball-cock being housed in the tank body 1, there occurs the case where interference with such a ball-cock cannot be avoided and, accordingly, a bulkiness in the height of the tank body 1 also becomes great.

On the contrary, in the case where the spacer 8*a* is made to be incorporated in the upper end side of the driving arm 8, the discharge valve body 3 can be used at the same height shown in the example of FIG. 1, and there is no necessity of increasing the height of the tank body 1.

Figure 4:
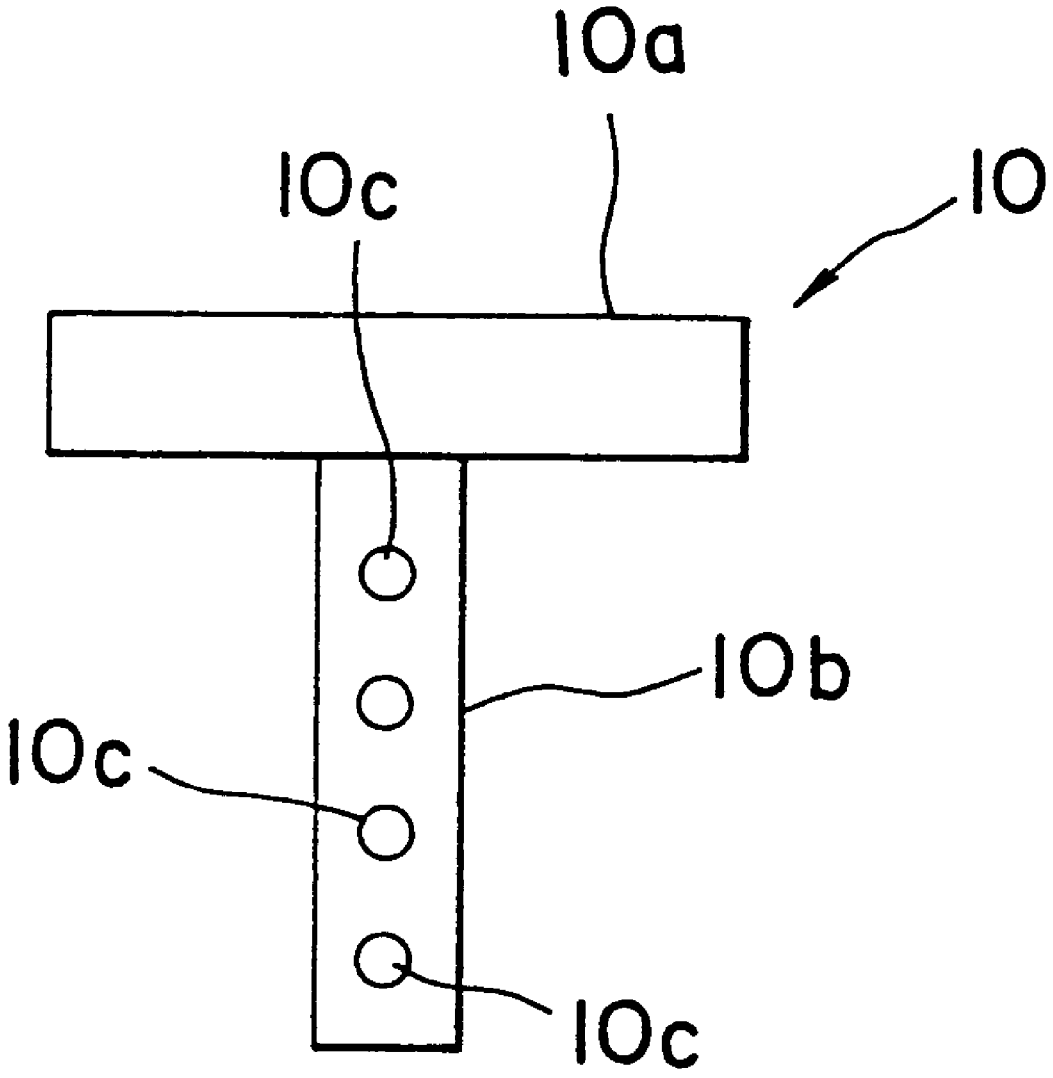
FIG. 4 is a font view showing other embodiment of a spacer.

FIG. 4 is a view showing a further embodiment of the above-described spacer which is removably attachable to the upper end of the driving arm 8. This spacer 10 is of a T-shape and comprises a pressure receiving part 10*a* for receiving the lower end of the spindle 7*b*, and a fixed part 10*b* securable to the driving arm 8. The fixed part 10*b* has four holes 10*c*. If a pin (not shown) is inserted into any one of these holes 10*c* and is driven in a hole in the forward end of the driving arm 8, the height of the pressure receiving part 10*a* relative to the driving arm 8 can be regulated in four steps since the holes 10*c* extending therethrough are arranged four in number in the up and down direction.

Figure 5:
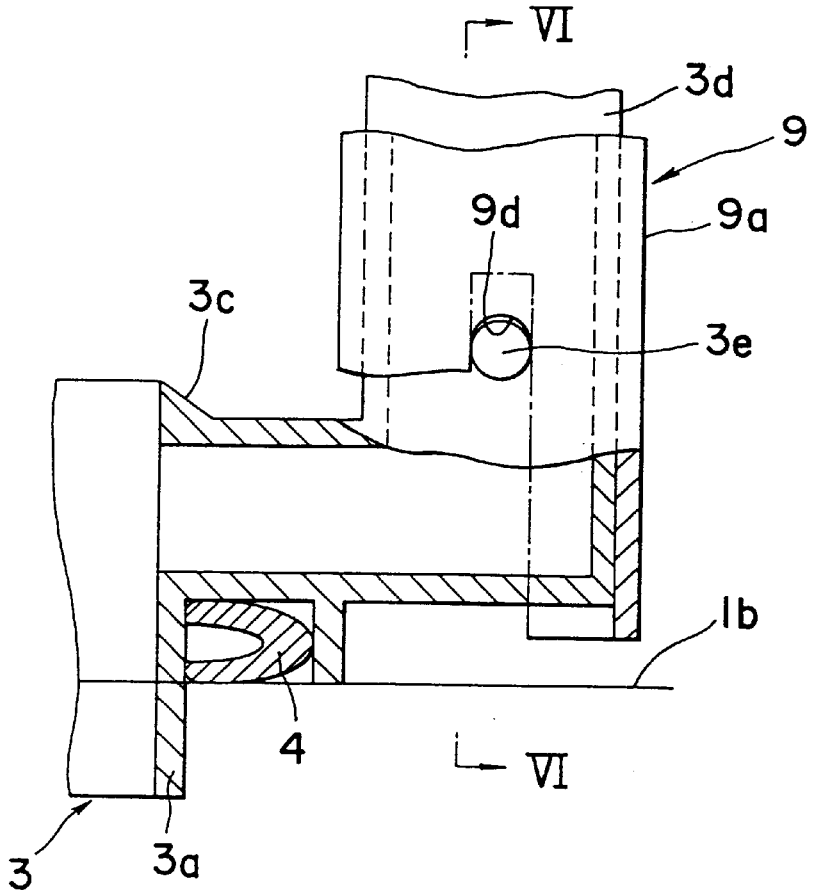
FIG. 5 is a side view of an essential portion of a further embodiment of the invention, with parts partially broken away.
Figure 6:
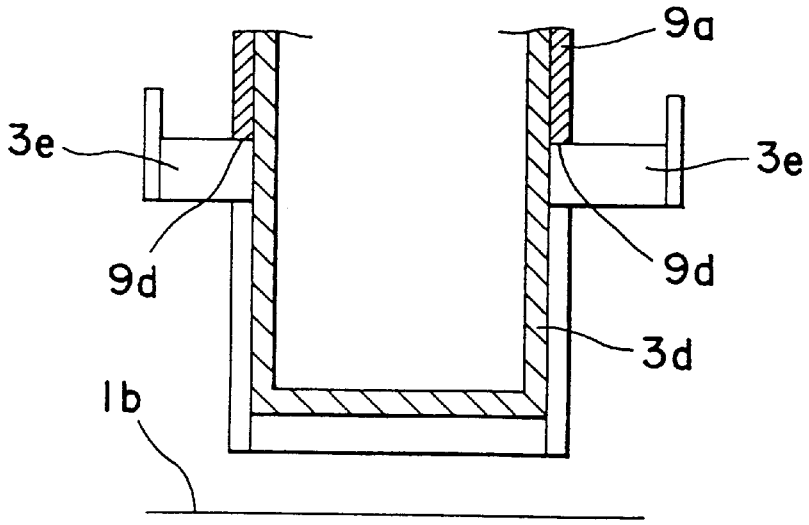
FIG. 6 is a sectional view taken along line VI—VI of FIG. 5.
Figure 7:
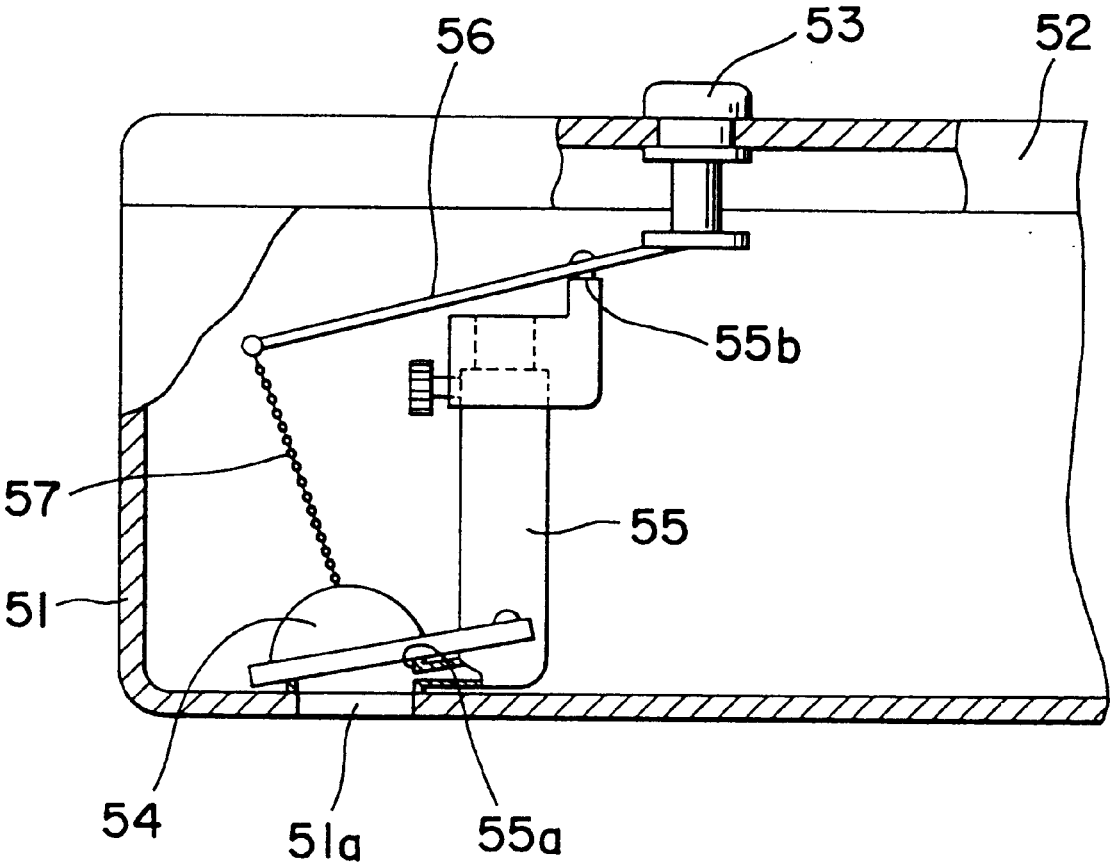
FIG. 7 is a side view of an outline of a flushing water tank device in the prior art, with parts partially broken away.

Moreover, FIG. 5 is a sectional view of an essential portion showing another embodiment of the construction of connecting the support member 9 to the overflow pipe 3*d*, and FIG. 6 is a longitudinal sectional view taken along line VI—VI of FIG. 5.

In this embodiment, the sleeve 9*a* is fitted onto and fixed to the overflow pipe 3*d*, and the length of the sleeve 9*a* is determined so that the lower end thereof does not strike the bottom surface 1*b* of the tank body 1. Namely, the lower end portion of the sleeve 9*a* is cut away at about half the side directed to the valve seat 3*c* and is formed with short slits 9*d* each fitting onto the hook 3*e* so as to cover it from above. When the slits 9*d* are loosely fitted onto the hooks 3*e*, the lower end of the sleeve 9*a* is positioned vertically away from the bottom surface 1*b* of the tank body 1, and the support member 9 is vertically supported only by the hooks 3*e* of the overflow pipe 3*d*, whereby the construction of assembly in which the support member 9 does not come into direct contact with the tank body 1 can be provided.

With the construction of linking such a sleeve 9*a* to the overflow pipe 3*d*, the load applied when the push-button 7*a* is pressed is concentrated on the hooks 3*e* by way of the sleeve 9*a* and, finally, the load escapes from the discharge valve body 3 to the tank body 1. In this case, since the hooks 3*e*, to which the load from the sleeve 9*a* is applied, are positioned at the lower side of the overflow pipe 3*d*, the bending moment applied to the discharge valve body 3 can be made smaller compared with the example in the prior art. Therefore, the deflection and deformation of the discharge valve body 3 can be suppressed, and the situation of closing the valve, with a sitting engagement of the valve body 5 with the valve seat 3*c* being properly kept, can be maintained, similar to the embodiment shown in FIGS. 1 and 2.

Further, the sleeve 9*a* does not come into contact with the bottom surface 1*b* of the tank body 1, and the height thereof is set only by the hooks 3*e* of the overflow pipe 3*d*. For this reason, if only the discharge valve body 3 is installed correctly in terms of the height, regardless of the precision of the bottom surface of the tank body 1, the sleeve 9*a* can be properly incorporated regardless of the manufacturing precision of the tank body 1. Accordingly, as explained with reference to FIG. 1, the positional relation between the driving arm 8 and the spindle 7*b* can be properly maintained, thereby making it possible to assemble the device in such a way as to absorb the dimensional tolerance of the tank body 1 and lid 2.

As described above, since, in the present invention, the action of a load to the discharge valve side from the driving member receiving the downward pressure from the operating part side is prevented using the support member composed of a separate member from the discharge valve, the deflection and deformation of the sealing part provided between the discharge valve and the tank body or between the discharge valve and the flow passage of the toilet bowl body are surely prevented, thereby making it possible to prevent a poor sealing property and a leakage of water.

Further, even in the case where the support member is fitted onto the overflow pipe provided so as to communicate with the discharge valve, a load at the time of operation does not act on the overflow pipe and the deflection and deformation thereof are prevented and, simultaneously, a fatigue due to the repeated stress can be suppressed, thus providing an increase in durability.

Moreover, even in the case in which a load of the support member is applied to the hooks provided at the lower end of the discharge valve or at the lower side of the overflow pipe, deflection and deformation of the discharge valve can be prevented in a similar way and, besides, keeping the support member out of contact with the bottom surface of the tank body makes it possible to properly maintain a positional relation between the support member and the spindle at the side of the operating part regardless of a change in height due to the precision of the bottom surface of the tank body, thus providing a stable motion.

Further, in the case in which the slot is provided on the driving arm to allow the downward motion of the linking end of the connecting chain member when the valve is opened, an angle, through which the driving arm can be pivotally moved, is set to a large degree, thereby allowing the degree of opening the valve to be made large, so that a force of water necessary to flush the toilet bowl can be obtained and, further, the products which are stable in terms of water-cut off performance and which have a high reliability can be provided.

Application of the present invention to the tank device for storing the flushing water of the flush toilet bowl allows the durability and prevention of water leakage of the tank device to be increased. Further, since the present invention makes efficient use of the flushing water possible, the flush tank can be made small in size and the used flushing water can be made small in quantity.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

We claim:

1. A tank device for flushing a toilet bowl comprising a tank body in which flushing water is stored and in which a bottom opening is provided for discharge, a discharge valve provided linked to the bottom opening of said tank body, a valve body which is adapted to be brought into a seating engagement with a valve seat formed on the upper end of said discharge valve, and an operating part for separating said valve body from said valve seat, said operating part comprising:

a driving member which brings about separating motion of said valve body from said valve seat by an operation of pressure from outside of the tank body; and a support member for supporting said driving member, said support member being supported by a lower portion of said discharge valve, wherein an overflow pipe is disposed with a vertical rise within the tank body which communicates with the downstream side of said valve seat of the discharge valve, and said support member is fitted onto said overflow pipe, the lower portion of said support member being formed with short longitudinal slits each fitting onto hooks provided so as to protrude from the lower portion of said overflow pipe when said support member is moved along said vertical rise of said overflow pipe.

2. The tank device for flushing a toilet bowl as claimed in claim 1, wherein said support member comprises a sleeve fitted onto said overflow pipe and a bracket provided so as to protrude from the upper portion of said sleeve, said bracket having at the forward end thereof said driving member connected thereto.

3. The tank device for flushing a toilet bowl as claimed in claim 1, wherein said driving member comprises:

a push-button disposed on the upper surface of the tank body;

a spindle connected to said push-button, supported by way of an elastic member by said tank body and extending downwardly within the tank body; and a driving arm which abuts the lower end of said spindle at one end thereof and which is connected at the other end to a connecting chain member connected to said valve body, said driving arm being attached at the middle portion thereof to said support member for up and down swinging motion.

4. The tank device for flushing a toilet bowl as claimed in claim 3, wherein a spacer which abuts the lower end of said spindle is removably attached to one end of the driving arm of said driving member.

5. The tank device for flushing a toilet bowl as claimed in claim 3, wherein the driving arm of said driving member is formed at the other end thereof with a slot extending in the longitudinal direction of the driving arm, and one end of said connecting chain member is linked to the slot movably along said slot.

6. The tank device for flushing a toilet bowl as claimed in claim 1, wherein said driving member comprises:

a push-button disposed on the upper surface of the tank body;

a spindle connected to said push-button, supported by way of an elastic member by said tank body and extending downwardly within the tank body; and a driving arm which abuts the lower end of said spindle at one end thereof and which is connected at the other end to a connecting chain member connected to said valve body, wherein said support member comprises a sleeve fitted onto said overflow pipe and a bracket provided so as to protrude from the upper portion of said sleeve, said bracket having at the forward end thereof the driving arm of said driving member attached at the middle portion thereof for up and down swinging motion.

7. A tank device for flushing a toilet bowl comprising a tank body in which flushing water is stored and in which a bottom opening is provided for discharge, a discharge valve provided linked to the bottom opening of said tank body, a valve body which is adapted to be brought into a seating engagement with a valve seat formed on the upper end of said discharge valve, and an operating part for separating said valve body from said valve seat, said operating part comprising:

a driving member which brings about separating motion of said valve body from said valve seat by an operation of pressure from outside of the tank body; and a support member for supporting said driving member, said support member being supported by said tank body, wherein an overflow pipe is disposed with a vertical rise within the tank body which communicates with the downstream side of said valve seat of the discharge valve, and said support member is fitted onto said overflow pipe and the lower end of said support member is seated on the bottom surface of the tank body, wherein said driving member comprises:

a push-button disposed on the upper surface of the tank body;

a spindle connected to said push-button, supported by way of an elastic member by said tank body and extending downwardly within the tank body; and a driving arm which abuts the lower end of said spindle at one end thereof and which is connected at the other end to a connecting chain member connected to said valve body, and wherein said support member comprises a sleeve fitted onto said overflow pipe and a bracket provided so as to protrude from the upper portion of said sleeve, said bracket having at the forward end thereof the driving arm of said driving member attached at the middle portion thereof for up and down swinging motion.

8. A tank device for flushing a toilet bowl comprising a tank body in which flushing water is stored and in which a bottom opening is provided for discharge, a discharge valve provided linked to the bottom opening of said tank body, a valve body which is adapted to be brought into a seating engagement with a valve seat formed on the upper end of said discharge valve, and an operating part for separating said valve body from said valve seat, said operating part comprising:

a driving member which brings about separating motion of said valve body from said valve seat by an operation of pressure from outside of the tank body; and a support member for supporting said driving member, said support member being supported by said tank body, wherein said driving member comprises:

a push-button disposed on the upper surface of the tank body;

a spindle connected to said push-button, supported by way of an elastic member by said tank body and extending downwardly within the tank body; and a driving arm which abuts the lower end of said spindle at one end thereof and which is connected at the other end to a connecting chain member connected to said valve body, said driving arm being attached at the middle portion thereof to said support member for up and down swinging motion, wherein a spacer which abuts the lower end of said spindle is removably attached to one end of the driving arm of said driving member.

9. A tank device for flushing a toilet bowl comprising a tank body in which flushing water is stored and in which a bottom opening is provided for discharge, a discharge valve provided linked to the bottom opening of said tank body, a valve body which is adapted to be brought into a seating engagement with a valve seat formed on the upper end of said discharge valve, and an operating part for separating said valve body from said valve seat, said operating part comprising:

a driving member which brings about separating motion of said valve body from said valve seat by an operation of pressure from outside of the tank body; and a support member for supporting said driving member, said support member being supported by a lower portion of said discharge valve, wherein said driving member comprises:

a push-button disposed on the upper surface of the tank body;

a spindle connected to said push-button, supported by way of an elastic member by said tank body and extending downwardly within the tank body; and a driving arm which abuts the lower end of said spindle at one end thereof and which is connected at the other end to a connecting chain member connected to said valve body, said driving arm being attached at the middle portion thereof to said support member for up and down swinging motion, wherein a spacer which abuts the lower end of said spindle is removably attached to one end of the driving arm of said driving member.

* * * * *